US009437062B2

(12) United States Patent
Ahearn et al.

(10) Patent No.: US 9,437,062 B2
(45) Date of Patent: Sep. 6, 2016

(54) ELECTRONIC LOCK AUTHENTICATION METHOD AND SYSTEM

(71) Applicant: Schlage Lock Company LLC, Indianapolis, IN (US)

(72) Inventors: John Robert Ahearn, Pasadena, CA (US); Joseph Wayne Baumgarte, Carmel, IN (US); Gabriel Daniel Focke, Indianapolis, IN (US); Michael Scott Henney, Indianapolis, IN (US)

(73) Assignee: Schlage Lock Company LLC, Indianapolis, IN (US)

( * ) Notice: Subject to any disclaimer, the term of this patent is extended or adjusted under 35 U.S.C. 154(b) by 176 days.

(21) Appl. No.: 13/968,671

(22) Filed: Aug. 16, 2013

(65) Prior Publication Data

US 2014/0049362 A1 Feb. 20, 2014

Related U.S. Application Data

(60) Provisional application No. 61/684,114, filed on Aug. 16, 2012.

(51) Int. Cl.
*G07C 9/00* (2006.01)

(52) U.S. Cl.
CPC ..... *G07C 9/00174* (2013.01); *G07C 9/00571* (2013.01); *G07C 9/00309* (2013.01)

(58) Field of Classification Search
CPC ..... G07C 9/00174; G07C 9/00309; G07C 9/00571; G07C 2009/00317; G07C 2009/00365; G07C 2009/00373; G07C 2009/0038; G07C 2009/00412; E05B 77/48; H04W 8/245; G06K 19/0727
See application file for complete search history.

(56) References Cited

U.S. PATENT DOCUMENTS

| | | | |
|---|---|---|---|
| 5,046,084 | A | 9/1991 | Barrett et al. |
| 5,654,696 | A | 8/1997 | Barrett et al. |
| 6,133,847 | A | 10/2000 | Yang |
| 6,407,779 | B1 | 6/2002 | Herz |
| 6,937,140 | B1 | 8/2005 | Outslay et al. |
| 6,968,153 | B1 | 11/2005 | Heinonen et al. |

(Continued)

FOREIGN PATENT DOCUMENTS

JP 2009019423 A 1/2009

OTHER PUBLICATIONS

European Extended Search Report; European Patent Office; European Patent Application No. 13829433.5; Mar. 24, 2016; 17 pages.

*Primary Examiner* — An T Nguyen
(74) *Attorney, Agent, or Firm* — Taft Stettinius & Hollister LLP

(57) ABSTRACT

An electronic lock authentication system and associated method including an electronic lock and a cellular phone in communication with a network and in wireless communication with the electronic lock. The electronic lock has a lock identification and is configured to transmit the lock identification wirelessly to the cellular phone. The cellular phone has a phone identification and is configured to transmit the lock identification and the phone identification to the network. The network is configured to make a decision in real time whether the cellular phone is permitted access to the electronic lock based on the lock identification and the phone identification, and is further configured to transmit a grant/deny message to the cellular phone based on the decision, and the cellular phone is configured to transmit the grant/deny message to the electronic lock.

8 Claims, 2 Drawing Sheets

(56) References Cited

U.S. PATENT DOCUMENTS 7,933,945 B2 4/2011 Krzyzanowski et al.
7,933,968 B1 4/2011 Zimmerman
8,037,511 B1 * 10/2011 Lundy ..... E05B 47/00 340/686.6
8,922,334 B2 12/2014 Hale et al.
2002/0002507 A1 1/2002 Hatakeyama
2004/0119894 A1 6/2004 Higgins et al.
2006/0072755 A1 * 4/2006 Oskari ..... G06F 21/35 380/270
2006/0170533 A1 8/2006 Chioiu et al.
2007/0050259 A1 3/2007 Wesley
2007/0130476 A1 6/2007 Mohanty
2007/0290789 A1 12/2007 Segev et al.
2008/0261560 A1 * 10/2008 Ruckart ..... G07C 9/00103 455/411
2009/0259957 A1 10/2009 Slocum et al.
2010/0017736 A1 1/2010 Kim
2010/0138764 A1 6/2010 Hatambeiki et al.
2010/0229194 A1 9/2010 Blanchard et al.
2010/0283579 A1 * 11/2010 Kraus ..... G07C 9/00944 340/5.7
2010/0298032 A1 11/2010 Lee et al.
2011/0202415 A1 8/2011 Casares et al.
2011/0246904 A1 10/2011 Pinto et al.
2011/0311052 A1 * 12/2011 Myers ..... G07C 9/00103 380/270
2012/0068817 A1 3/2012 Fisher
2012/0072944 A1 3/2012 Felt et al.
2012/0095791 A1 4/2012 Stefik et al.
2012/0100868 A1 * 4/2012 Kim ..... H04W 4/023 455/456.1
2012/0157080 A1 6/2012 Metivier
2012/0280790 A1 11/2012 Gerhardt et al.
2012/0287058 A1 11/2012 Lee
2013/0031261 A1 1/2013 Suggs
2013/0165180 A1 6/2013 Fukuda Kelley et al.
2013/0324237 A1 * 12/2013 Adiraju ..... G07F 17/3223 463/29
2014/0007222 A1 1/2014 Qureshi et al.
2014/0049362 A1 * 2/2014 Ahearn ..... G07C 9/00174 340/5.51
2014/0049363 A1 2/2014 Ahearn et al.
2014/0049364 A1 2/2014 Ahearn et al.
2014/0049365 A1 2/2014 Ahearn et al.
2014/0049366 A1 * 2/2014 Vasquez ..... G07C 9/00857 340/5.54

* cited by examiner

ELECTRONIC LOCK AUTHENTICATION METHOD AND SYSTEM

CROSS-REFERENCE TO RELATED APPLICATIONS

The present application claims the benefit of U.S. Provisional Patent Application No. 61/684,114 filed on Aug. 16, 2012, the contents of which are incorporated herein by reference in their entirety.

TECHNICAL FIELD

The technical field generally relates to an electronic lock authentication method and system, and more particularly, but not exclusively, relates to electronic lock authentication via a network and a cellular telephone.

BACKGROUND

Authentication systems may include an access control panel (ACP) which makes an access control decision. The authentication may be between a controller and the ACP. Some existing systems have various shortcomings relative to certain applications. Accordingly, there remains a need for further contributions in this area of technology.

SUMMARY

One embodiment of the present invention is a unique electronic lock authentication system. Other embodiments include apparatuses, systems, devices, hardware, methods, and combinations for electronic lock authentication. Further embodiments, forms, features, aspects, benefits, and advantages of the present application shall become apparent from the description and figures provided herewith.

DETAILED DESCRIPTION OF THE ILLUSTRATIVE EMBODIMENTS

Figure 1:
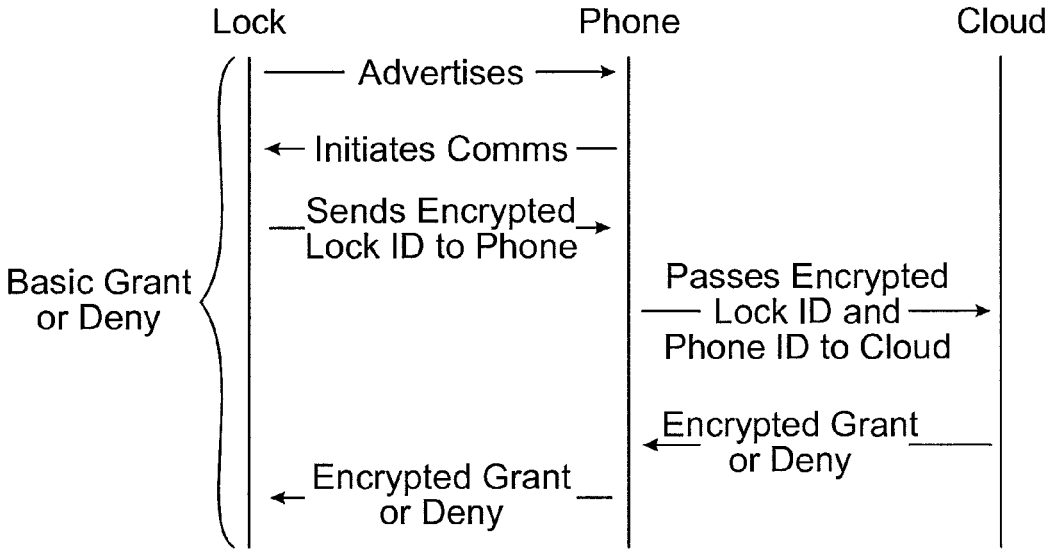
FIG. 1 is a diagram illustrating an electronic lock authentication system and method.

For the purposes of promoting an understanding of the principles of the invention, reference will now be made to the embodiments illustrated in the drawings and specific language will be used to describe the same. It will nevertheless be understood that no limitation on the scope of the invention is hereby intended. Any alterations and further modifications in the described embodiments, and any further applications of the principles of the invention as described herein are contemplated as would normally occur to one skilled in the art to which the invention relates.

With reference to FIG. 1, an electronic lock authentication system and method in one embodiment includes communication between a lock, a cellular telephone, and a network. The cellular telephone may be a smartphone, for example, and the network may be a network cloud, for example.

The lock advertises its presence, for example, while in a low power sleep state. The lock may perform such advertising, for example, once every 'x' amount of time. The cellular telephone scans for devices in its range, which may occur, for example, when the cellular telephone is in a low power scan mode. When a lock is in range, the cellular telephone initiates communication with the lock. The lock, in turn, transmits its encrypted Lock ID to the cellular telephone. The cellular telephone then transmits the encrypted Lock ID and its Phone ID to the network cloud.

The network cloud makes a decision, which in one embodiment may be in real time, as to whether the cellular telephone is permitted access to the door based on the Lock ID and the Phone ID.

The network cloud then transmits an encrypted grant or deny message to the cellular telephone, which in turn transmits the encrypted grant or deny message to the lock.

Figure 2:
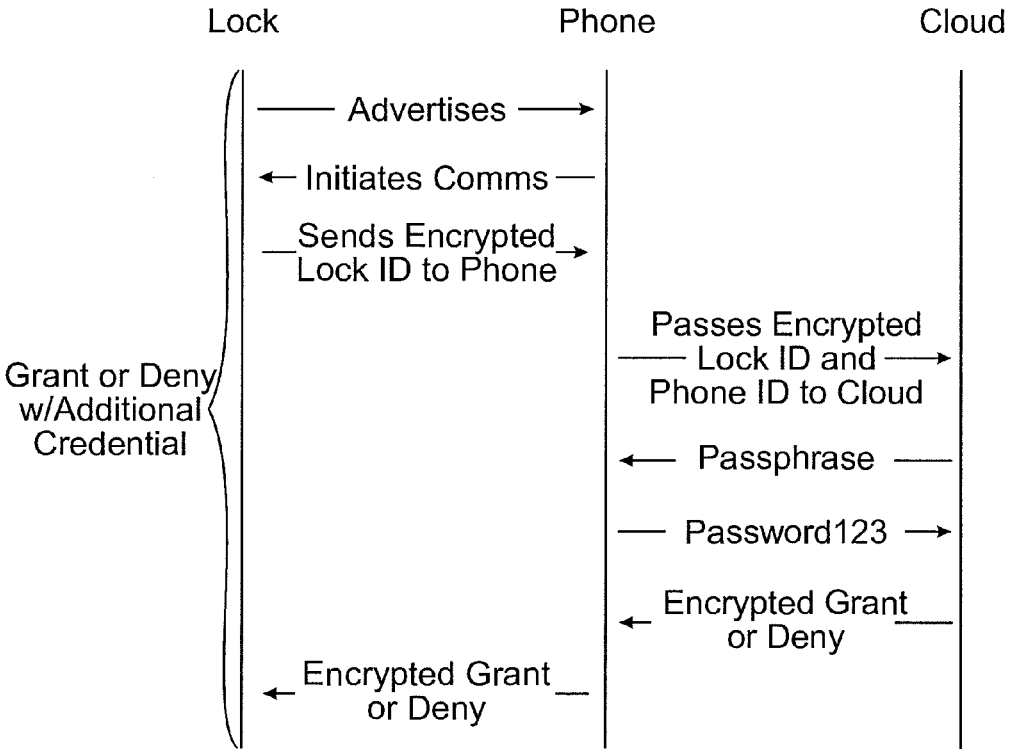
FIG. 2 is a diagram illustrating an electronic lock authentication system and method that makes use of credential information.

FIG. 2 illustrates an electronic lock authentication system and method, which, as in the FIG. 1 embodiment, includes communication between a lock, a cellular telephone, and a network. In the FIG. 2 embodiment, the cellular telephone transmits additional credential information.

The lock advertises its presence, for example, while in a low power sleep state. The lock may perform such advertising, for example, once every 'x' amount of time. The cellular telephone scans for devices in its range, which may occur, for example, when the cellular telephone is in a low power scan mode. When a lock is in range, the cellular telephone initiates communication with the lock. The lock, in turn, transmits its encrypted Lock ID to the cellular telephone. The cellular telephone then transmits the encrypted Lock ID and its Phone ID to the network cloud.

The network cloud makes a decision, which in one embodiment may be in real time, as to whether the cellular telephone is permitted access to the door based on the Lock ID and the Phone ID.

In the FIG. 2 embodiment, the network cloud requests additional credential information from the cellular telephone, which may be provided, for example, by the user of the cellular telephone. The network cloud transmits a message to the cellular telephone indicating additional credential information is required. In one embodiment, the user of the cellular telephone inputs the required additional credential information into the cellular telephone. This input can be different credential types, for example, a pin code, a passphrase, a gesture with the phone, and facial or voice recognition to the network cloud via the cellular telephone.

The network cloud then makes a decision, which in one embodiment may be in real time, as to whether the additional credential information is correct.

The network cloud then transmits an encrypted grant or deny message to the cellular telephone, which in turn transmits the encrypted grant or deny message to the lock.

In one embodiment, the system architecture allows the major communication pipeline to be between the cellular telephone and the cloud, which in turn allows the electronics resident on the door to be a much simpler and smaller form factor design.

In one embodiment, the system architecture provides ways to provide additional credential information to the network cloud which may take the form of for example a "phone+additional credential information" application.

In one embodiment, real time access control verification allows for no wires to be needed in an installation. Further, the electronic lock may be battery powered and have the ability to "go online" through the cellular telephone's interne connection. In one embodiment, the cellular telephone would provide the communication path between the lock and the network cloud, allowing a real time access control decision, without a hardwired connection for the lock.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected.

It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. A method of authenticating a lock system, comprising:

issuing via an electronic lock an advertisement indicating a presence of the electronic lock to a cellular phone, wherein the issuing is performed while the electronic lock is in a low power sleep state;

scanning via the cellular phone for the advertisement, wherein the scanning is performed when the cellular phone is in a low power scan mode;

initiating wireless communication by the cellular phone with the electronic lock, wherein the initiating is performed in response to the cellular phone determining that the electronic lock is in a specified range;

transmitting an encrypted lock identification from the electronic lock to the cellular phone after initiating the wireless communication;

transmitting the encrypted lock identification and an encrypted phone identification from the cellular phone to a network;

requesting via the network additional credential information from the cellular phone;

transmitting the additional credential information from the cellular phone to the network;

determining via the network whether the cellular phone is permitted access to the electronic lock based at least in part on the encrypted lock identification, the encrypted phone identification, and the additional credential information;

transmitting an encrypted grant/deny message from the network to the cellular phone based upon the determining; and transmitting the encrypted grant/deny message from the cellular phone to the electronic lock.

2. The method of claim 1, further comprising inputting the additional credential information into the cellular phone in response to the requesting.

3. The method of claim 2, wherein the additional credential information includes data relating to at least one of a pin code, a passphrase, a gesture with the cellular phone, facial recognition, and voice recognition.

4. The method of claim 1, wherein the network comprises a network cloud.

5. An electronic lock authentication system, comprising:

an electronic lock, wherein the electronic lock has a low power sleep state;

a cellular phone in communication with a network and in wireless communication with the electronic lock, wherein the cellular phone is operable in a low power scan mode and the electronic lock is configured to advertise its presence to the cellular phone while in the low power sleep state, and further wherein the cellular phone is configured to scan for the electronic lock in wireless communication range while in the low power scan mode and to initiate wireless communication with the electronic lock that are determined to be in wireless communication range;

wherein the electronic lock has a lock identification and is configured to encrypt the lock identification and transmit the encrypted lock identification wirelessly to the cellular phone after the cellular phone initiates wireless communication with the electronic lock;

wherein the cellular phone has a phone identification and is configured to encrypt the phone identification and transmit the encrypted lock identification and the encrypted phone identification to the network;

wherein the network is configured to make a decision in real time whether the cellular phone is permitted access to the electronic lock based at least in part on the encrypted lock identification and the encrypted phone identification, wherein the network is configured to transmit a message to the cellular phone indicative of a requirement for additional credential information in order to make the decision;

wherein a user of the cellular phone is prompted to input the additional credential information into the cellular phone in response to the message from the network;

wherein the network is further configured to determine whether the additional credential information is correct and transmit an encrypted grant/deny message to the cellular phone based on the decision; and wherein the cellular phone is configured to transmit the encrypted grant/deny message to the electronic lock.

6. The system of claim 5, wherein the network comprises a network cloud.

7. The system of claim 5, wherein the cellular phone comprises a smartphone.

8. The system of claim 5, wherein the electronic lock comprises a smart lock.

* * * * *